US005109554A

United States Patent [19]

Borders et al.

[11] Patent Number: 5,109,554

[45] Date of Patent: May 5, 1992

[54] SHIELD FOR BIRTHING BED

[75] Inventors: Richard L. Borders, Cincinnati; David C. Newkirk, Fairfield, both of Ohio; Daniel G. Stafford, Batesville, Ind.

[73] Assignee: Hill-Rom Company, Inc., Batesville, Ind.

[21] Appl. No.: 684,991

[22] Filed: Apr. 15, 1991

[51] Int. Cl.[5] ..... A61G 7/00

[52] U.S. Cl. ..... 5/602; 5/68

[58] Field of Search ..... 5/66-69; 269/322-325

[56] References Cited

U.S. PATENT DOCUMENTS 2,477,400 7/1949 Beem et al. ..... 5/69
2,719,769 10/1955 Murphy ..... 269/325
4,725,270 9/1988 Schuldt et al. ..... 269/322 X
4,768,249 9/1988 Goodwin ..... 5/66 X

FOREIGN PATENT DOCUMENTS 2230948 11/1990 United Kingdom ..... 269/325

*Primary Examiner*—Michael F. Trettel
*Attorney, Agent, or Firm*—Wood, Herron & Evans

[57] ABSTRACT

A birthing bed has a base, a frame supported by a parallelogram linkage above the base and articulating body support panels mounted on the frame. A mechanism, mounted in the frame, is provided for raising and lowering of the frame with respect to the base and for operating the articulating body support panels. The body support panels include a head panel that is pivoted adjacent a seat panel. A flexible plastic shield overlies the joint between the seat and head panel to protect the operating mechanism from fluids discharged during the birthing process.

2 Claims, 2 Drawing Sheets

SHIELD FOR BIRTHING BED

This invention relates to a birthing bed as well as other hospital beds.

The birthing bed to which the present invention is directed has a base, a frame mounted by parallelogram linkage to the base and patient support panels mounted on the frame. The patient support panels include a seat panel and a head panel that are pivoted to the frame and have a joint between them. The frame contains a power mechanism for raising and lowering the bed and pivoting the articulating patient support panels.

SUMMARY OF THE INVENTION

An objective of the present invention has been to provide protection for the power mechanism contained within the frame against fluids discharged during the birthing process.

This objective of the invention has been attained by providing a flexible plastic strip permanently fastened across the joint between the head panel and the seat panel. The strip extends transversely well beyond the frame so that any fluids that might overrun the lateral edges of the strip will be prevented from running into the mechanism confined within the frame.

BRIEF DESCRIPTION OF THE DRAWINGS

The objective and features of the invention will become more readily apparent from the following detailed description taken in conjunction with the accompanying drawings in which.

DETAILED DESCRIPTION OF THE PREFERRED EMBODIMENT

Figure 1:
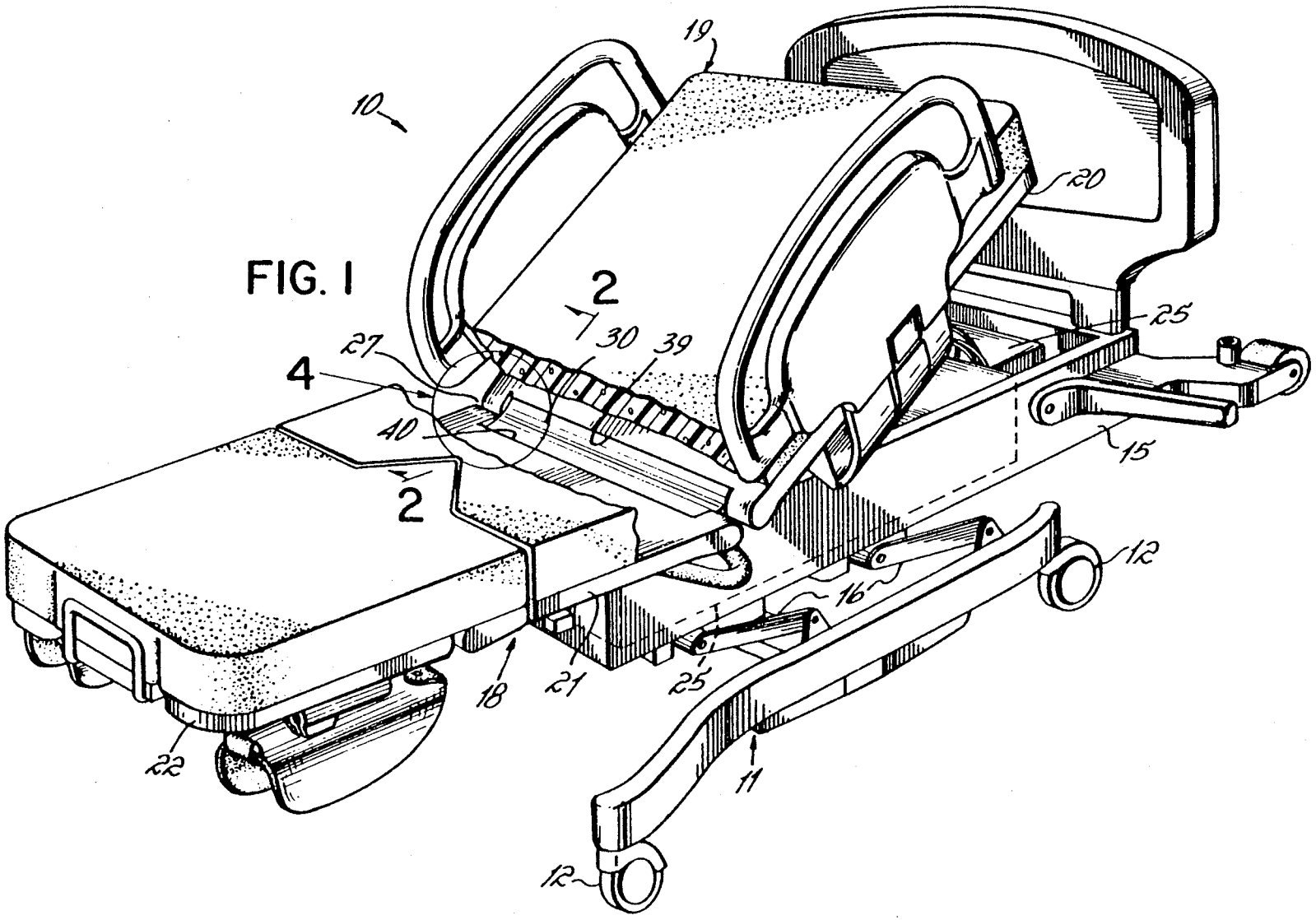
FIG. 1 is a perspective view, partly broken away, of a bed constructed in accordance with the present invention.

Referring to FIG. 1, a birthing bed 10 is shown having a frame 11 supported on casters 12 so that the bed may be easily moved from place to place. A bed frame 15 is mounted by a parallelogram linkage 16 to the frame 11. Body support panels 18 are pivotally mounted on the frame so that they can be adjusted from a horizontal attitude where the patient reclines horizontally to a chair-like orientation so that the patient can sit up. A mattress 19 covers the patient support panels 18. The panels 18 include a head panel 20, a seat panel 21 and a foot panel 22. A power mechanism 25 is mounted within the confines of the frame 15. The power mechanism is connected to the frame to raise and lower it and is connected to the patient support panels to pivot the head and seat panels with respect to each other and to raise and lower the foot panel 22. Overlying the power mechanism 25 is a joint 27 between the head panel 20 and the seat panel 21. That joint 27 could create a passageway for fluids discharged during the birthing process to flow, by gravity, downwardly into the power mechanism 25. To prevent that flow, a flexible plastic extrusion 30 overlies the central portion of the joint 27 and extends laterally well beyond the frame 15 so that any fluids passing over the side edges of the strip 30 will flow downwardly outside of the frame 15. The strip 30 has enlarged or thickened transverse edges 31 to facilitate attachment (FIG. 2).

Figure 2:
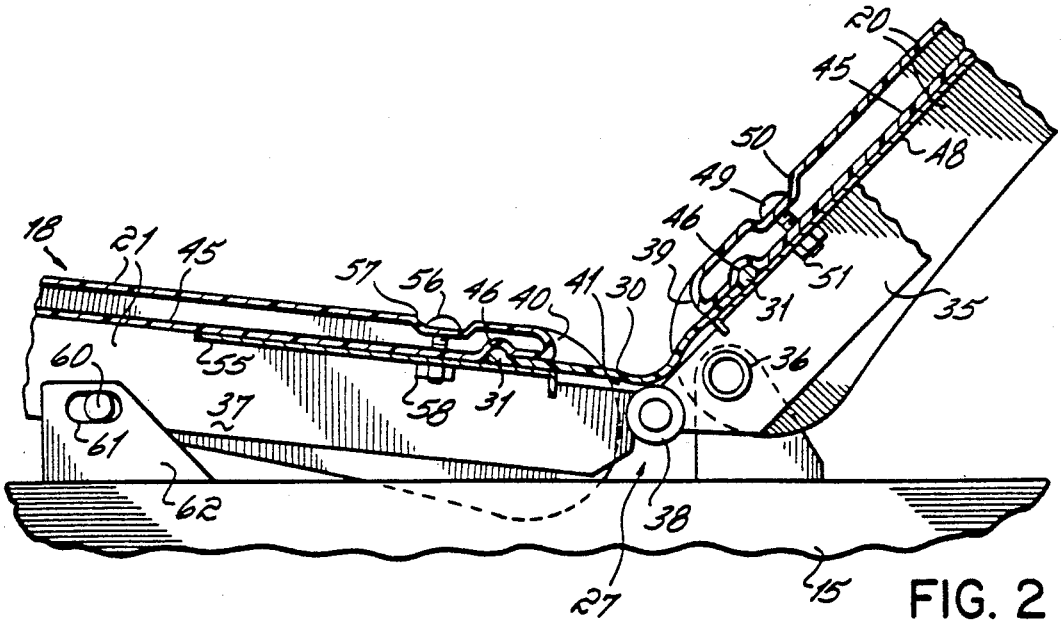
FIG. 2 is a partial cross-sectional view taken in lines 2—2 of FIG. 1.
Figure 4:
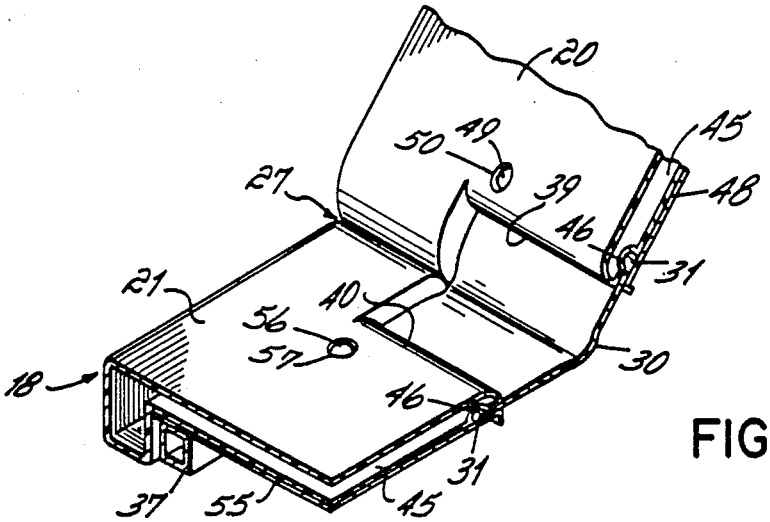
FIG. 4 is an enlarged schematic view of the encircled area on FIG. 1.

More specifically, as shown in FIG. 2, the head panel 20 is mounted at each side on a frame member 35, the frame member 35 being mounted on a shaft 36 for pivotal movement with respect to the frame 15. Similarly, the seat panel 21 is mounted on a frame 37 which is in turn mounted on a shaft 38 for pivotal movement with respect to the head panel frame. The head panel 20 has a transverse notch 39 and the seat panel 21 has a transverse notch 40 creating a gap 41 at the joint 27. The plastic extrusion 30 which forms the shield between head and seat panels 20 and 21 has thickened transverse edges 31. The head and seat panels 20 and 21 are hollow, blow-molded plastic members each having a bottom wall 45 (FIG. 4). Each bottom wall has at the edge adjacent the joint 27 a transverse groove 46. The transverse groove 46 receives the thickened edge 31 of the shield 30 to hold it in position. Under the head panel 20 is a sheet steel plate 48 that is secured to the frame member 35. The panel 20 is clamped to the plate 48 by several bolts 49 whose heads are disposed in depressions 50 formed in the upper surface of the panel 20. Nuts 51 fasten the bolts to the sandwich of panel 20 and plate 48. The shield 30 is thus clamped, at its thickened edge, between the panel 20 and the plate 48.

Similarly, the frame 37 for the seat panel has a sheet metal plate 55 secured to it. A bolt 56 whose head is disposed in a recess 57 in the upper surface of the seat panel 21 extends through the seat panel and the plate 55. A nut 58 mounted on the bolt 56 clamps the panel 21 to the plate 55. In so doing, the thickened edge 31 of the shield 30 is clamped in the groove 46 on the undersurface of the panel 21. Thus, the shield is held securely in place.

Figure 3:
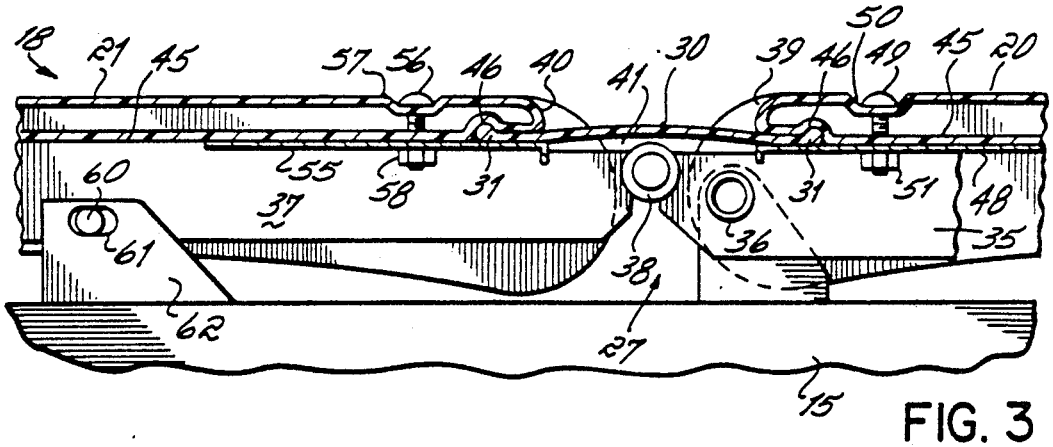
FIG. 3 is a view similar to FIG. 2 showing the panels lying horizontally.

The head panel frame 35 is pivoted on shaft 36 with respect to the frame 15. The seat panel frame 37 is pivoted on shaft 38 to the end of the head panel frame 35. The seat panel frame 37 has a pin 60 which travels longitudinally in slot 61 on a bracket 62 mounted to the bed frame 15, thereby permitting the seat panel to shift between the positions illustrated in FIGS. 2 and 3.

In the operation of the invention, during the birthing process the strip 30 shields the frame 15 and the mechanism 25 within it from the flow of fluids, as, for example, fluids that might run down the seat panel 21 between it and the mattress covering it. After the birthing process is over, the mattresses can be removed for laundering. The exposed surface of the patient support panels 18 can also be easily cleaned, including cleaning of the strip 30 that covers the joint 27.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A hospital bed comprising:

a base, a bed frame and linkage mounting the bed frame on the base, patient support panels mounted on the bed frame including a seat panel and a head panel that is pivotally mounted to create a joint therebetween adjacent the seat panel, each panel having at adjacent edges a transverse notch extending beyond said frame on each side of said frame, mechanism in said bed frame for raising and lowering said frame with respect to said base and for pivoting said head panel, and a flexible, moisture-impervious sheet bridging the joint between said head and seat panel, said sheet having end edges fastened within the respective notches and extending across the entire notch.

2. A hospital bed, comprising:

a base, a bed frame and linkage mounting the bed frame on the base, patient support panels mounted on the bed frame including a seat panel and a head panel that is pivotally mounted to create a joint therebetween adjacent the seat panel, mechanism in said bed frame for raising and lowering said frame with respect to said base and for pivoting said head panel, a flexible, moisture-impervious sheet bridging the joint between said head and seat panel, a transverse groove in the undersurface of the seat panel and the head panel adjacent the joint therebetween, said flexible sheet having thickened transverse edges seated in said transverse groove, and plates clamping said thickened edges securely in said grooves.

* * * * *